US010132315B2

(12) United States Patent
Lehmann

(10) Patent No.: US 10,132,315 B2
(45) Date of Patent: Nov. 20, 2018

(54) FLUID ENERGY MACHINE

(71) Applicant: MAN DIESEL & TURBO SE, Augsburg (DE)

(72) Inventor: Tim Lehmann, Gelsenkirchen (DE)

(73) Assignee: MAN Energy Solutions SE, Augsburg (DE)

( * ) Notice: Subject to any disclaimer, the term of this patent is extended or adjusted under 35 U.S.C. 154(b) by 95 days.

(21) Appl. No.: 15/147,072

(22) Filed: May 5, 2016

(65) Prior Publication Data

US 2016/0327044 A1 Nov. 10, 2016

(30) Foreign Application Priority Data

May 9, 2015 (DE) ..... 10 2015 006 106

(51) Int. Cl.

| | |
|---|---|
| ***G01D 21/00*** | (2006.01) |
| ***F04C 28/28*** | (2006.01) |
| ***F04C 18/16*** | (2006.01) |

(52) U.S. Cl.

CPC ..... *F04C 28/28* (2013.01); *F04C 18/16* (2013.01); *F04C 2240/605* (2013.01); *F04C 2270/12* (2013.01)

(58) Field of Classification Search

CPC ..... F04C 2270/12; F04C 28/28; G01D 11/30; G01B 5/0002

See application file for complete search history.

(56) References Cited

U.S. PATENT DOCUMENTS 3,859,847 A * 1/1975 Ronemus ..... G01H 1/003 73/660
4,018,083 A * 4/1977 Hoffman ..... G01H 1/003 73/660

(Continued)

FOREIGN PATENT DOCUMENTS

CN 2795491 7/2006
CN 101091104 12/2007

(Continued)

OTHER PUBLICATIONS

Search Report dated Dec. 15, 2016 which issued in the corresponding Great Britain Patent Application No. 1607696.0.

(Continued)

*Primary Examiner* — Audrey K Bradley
*Assistant Examiner* — Anthony Ayala Delgado
(74) *Attorney, Agent, or Firm* — Cozen O'Connor

(57) ABSTRACT

A fluid energy machine, with a machine housing (10), and with at least one shaft (11) that is mounted in the machine housing (10), which is assigned at least one sensor (12), with the help of which vibrations of the respective shaft are detectable, with at least one mounting sleeve (13), which extends through a bore (14) in the machine housing (10), wherein on a first portion (15) of the respective mounting sleeve (13), which faces the shaft, a sensor (12) is mounted, wherein in the region of the first portion (15) of the respective mounting sleeve (13) an adjusting device (16) is formed in order to align the respective sensor (12) relative to the respective shaft (11), and wherein on a portion (17) of the respective mounting sleeve (13) facing away from the shaft (11) a fixing device (18) engages in order to fix and seal the respective mounting sleeve (13) on the machine housing (10).

15 Claims, 3 Drawing Sheets

(56) References Cited

U.S. PATENT DOCUMENTS

| | | | | |
|---|---|---|---|---|
| 4,066,949 | A * | 1/1978 | Condrac | G01D 11/30 248/560 |
| 4,665,393 | A * | 5/1987 | Wilder | G01P 3/484 340/682 |
| 4,876,905 | A | 10/1989 | Callsen et al. | |
| 2008/0260541 | A1* | 10/2008 | Lifson | H02P 23/08 417/44.11 |
| 2008/0271548 | A1 | 11/2008 | Janz et al. | |

FOREIGN PATENT DOCUMENTS

| | | |
|---|---|---|
| CN | 102907182 | 1/2013 |
| CN | 204286782 | 4/2015 |
| DE | 202008007403 | 9/2008 |
| DE | 202008007404 | 9/2008 |

OTHER PUBLICATIONS

Office Action dated Jun. 1, 2018 which issued in the corresponding Chinese Patent Application No. 201610299818.7.

* cited by examiner

FLUID ENERGY MACHINE

BACKGROUND OF THE INVENTION

1. Field of the Invention

The invention relates to a fluid energy machine, in particular a screw compressor.

2. Background of the Invention

Fluid energy machines known from practice comprise a machine housing and at least one rotating shaft mounted in the machine housing. In particular when the fluid energy machine is embodied as screw compressor, two screw rotors each are mounted in the machine housing, each of which screw rotors comprises a rotating shaft.

From practice it is already known to detect shaft vibrations on fluid energy machines with the help of vibration sensors. In the process it is important that the sensor, which serves for detecting the shaft vibrations, is adjusted relative to the shaft and thus exactly aligned relative to the shaft. It is important, furthermore, that the sensor itself is not excited into vibrations since these could be erroneously interpreted as shaft vibrations. It is important, furthermore, to mount the respective vibration sensor on the machine housing subject to the provision of adequate sealing so that there is no danger that oil and/or gas gets into the surroundings of the fluid energy machine. Finally it is also important that no media enter the fluid energy machine from the outside.

Fluid energy machines known up to now, which comprise at least one sensor for detecting shaft vibrations, fulfil these requirements only to an insufficient extent. There is therefore a need for a new type of fluid energy machine with the help of which the above requirements can be fulfilled reliably, easily and in particular with regard to the great installation depths that are present in the machine housings. Starting out from this, the present invention is based on the object of creating a new type of fluid energy machine with respect to the detection of the vibrations of the shafts.

SUMMARY OF THE INVENTION

The fluid energy machine according to the invention comprises at least one mounting sleeve for fastening a sensor to the machine housing. The mounting sleeve extends through a bore in the machine housing. On a first portion of the mounting sleeve, which faces the shaft, the sensor is fastened or mounted for detecting shaft vibrations. In the region of this first portion an adjusting device is formed in order to align the respective sensor relative to the respective shaft. On the opposite second portion of the mounting sleeve, which faces away from the shaft, a fixing device engages in order to fix and seal the respective mounting sleeve on the machine housing.

According to the invention, the adjustment by way of the adjusting device and the fixing and sealing via the fixing device are accordingly functionally and spatially separated from one another.

Owing to the fact that the adjusting device is formed on the first portion of the mounting sleeve facing the shaft, the adjusting device simultaneously assumes the function of a vibration reduction for the sensor since the mounting sleeve as such, due to the fixing via the adjusting device, minimises the risk of vibration excitation of the sensor.

According to an advantageous further development, the adjusting device is designed as an adjusting thread, wherein the adjusting thread comprises an external thread on the first portion of the respective mounting sleeve and an internal thread on a portion of the bore of the machine housing facing the shaft. This configuration of the adjusting device is simple and allows a reliable, exact alignment of the sensor to the shaft subject to minimising a vibration excitation of the sensor.

According to an advantageous further development, the fixing device is a lock nut, the internal thread of which engages with an external thread of the respective mounting sleeve, which is formed on the second portion of the respective mounting sleeve projecting out of the bore of the machine housing and facing away from the shaft. Preferentially, a sealing element is then positioned between the mounting sleeve and the machine housing within the bore on a portion of the bore facing away from the shaft. In order to prevent the entry of media from without the fluid energy machine, an additional seal can be positioned between the machine housing and a portion of the lock nut outside the bore butting up against the same. These configurations of the fixing device on the portion of the mounting sleeve projecting out of the bore of the machine housing is simple and allows reliable fixing of the mounting sleeve on the machine housing and reliable sealing of the mounting sleeve relative to the bore of the machine housing.

According to an alternative advantageous further development, the fixing device is a hollow screw which in portions surrounds the mounting sleeve on a portion that projects out of the bore of the machine housing and the external thread of which engages with an internal thread of the bore, which is formed on a portion of the bore facing away from the shaft. Preferentially, the fixing device then comprises a sealing/clamping element which seals and clamps by way of the hollow screw. This configuration of the fixing device is also simple and reliable.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are explained in more detail by way of the drawing in which.

DETAILED DESCRIPTION OF THE PRESENTLY PREFERRED EMBODIMENTS

The present invention relates to a fluid energy machine, in particular a screw machine such as a screw compressor.

A fluid energy machine comprises a machine housing and at least one shaft mounted in the machine housing. In particular when the fluid energy machine is embodied as a screw compressor is the machine housing a compressor housing in which screw rotors forming a rotor pair are positioned and mounted. Here, each screw rotor comprises a shaft.

The present invention relates to such details of a fluid energy machine with the help of which vibrations on a shaft can be easily and reliably detected.

Figure 1:
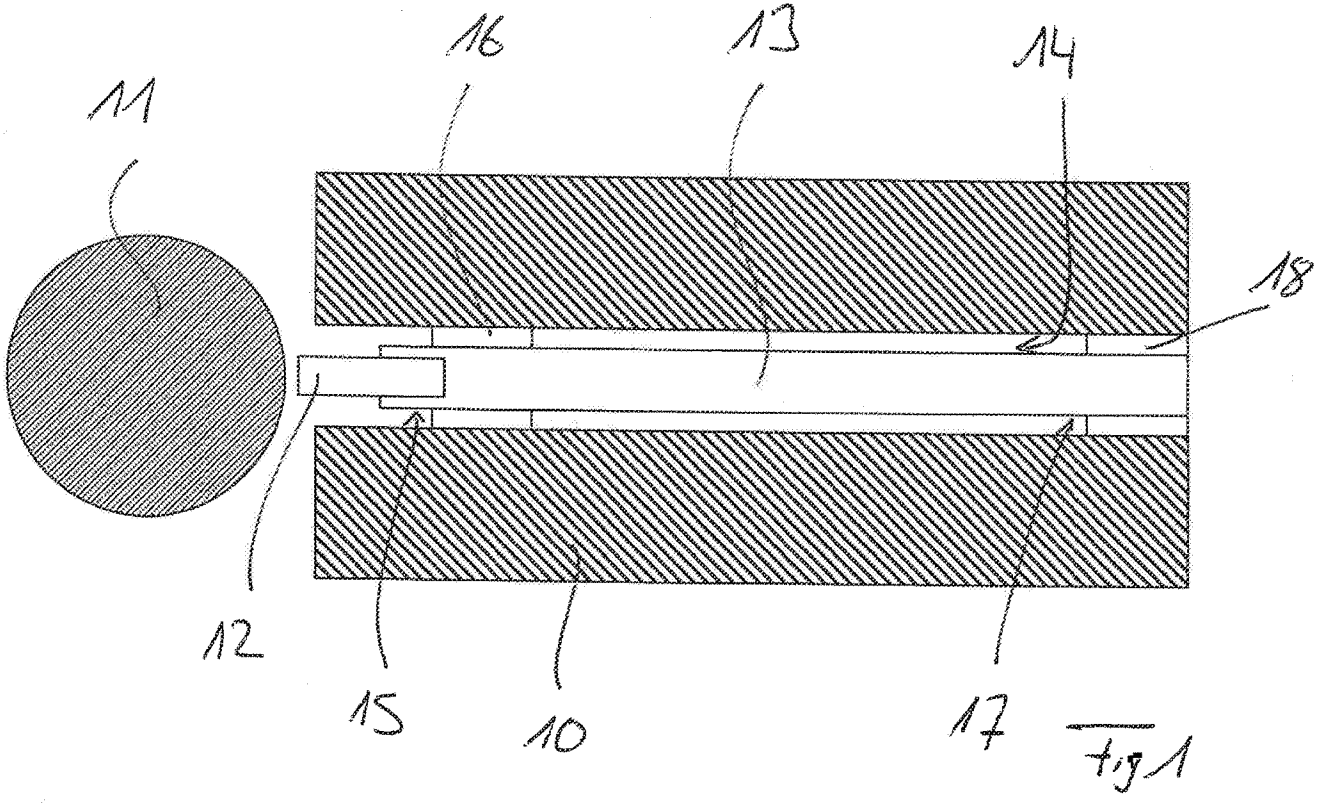
FIG. 1: is a highly schematic cross sectional view through a detail of a fluid energy machine according to the invention designed as screw compressor.

FIG. 1 shows a highly schematic extract from a fluid energy machine in the region of a machine housing 10 and a shaft 11 that is mounted in the machine housing 10. Furthermore, FIG. 1 shows a sensor 12 in order to detect vibrations of the shown shaft 11.

In terms of the present invention, the sensor 12 is mounted on a mounting sleeve 13. The mounting sleeve 13 in this case extends through a bore 14 in the machine housing 10.

On a first end or portion 15 of the mounting sleeve 13, which faces the shaft 11, the sensor 12 is mounted. In the region of this first end or portion 15 of the mounting sleeve 13, an adjusting device 16 is formed which serves for aligning the sensor 12 relative to the shaft 11.

On a second end of the mounting sleeve 13 located opposite the first end 15 of the mounting sleeve 13 or on a second portion 17 of the mounting sleeve 13 facing away from the shaft 11 a fixing device 18 engages with the mounting sleeve 13 in order to fix and seal the respective mounting sleeve 13 on the machine housing 10 relative to the same.

Adjusting device 16 and fixing device 18 accordingly engage with different ends or portions 15, 17 of the mounting sleeve 13 located opposite one another so that the adjusting function and the fixing and sealing function for the mounting sleeve 13 are not only functionally but also spatially separated from one another.

Furthermore, a vibration excitation of the sensor 12 is minimised since through the adjusting device 16 acting on the first end or portion 15 of the mounting sleeve 13 the free portion length of the mounting sleeve 13, which could be excited into vibrations, is reduced to an absolute minimum. This also brings about that changes in lengths of the assemblies due to heat expansion do not have any noticeable influence on the alignment of the sensor 12 relative to the shaft 11.

Figure 2:
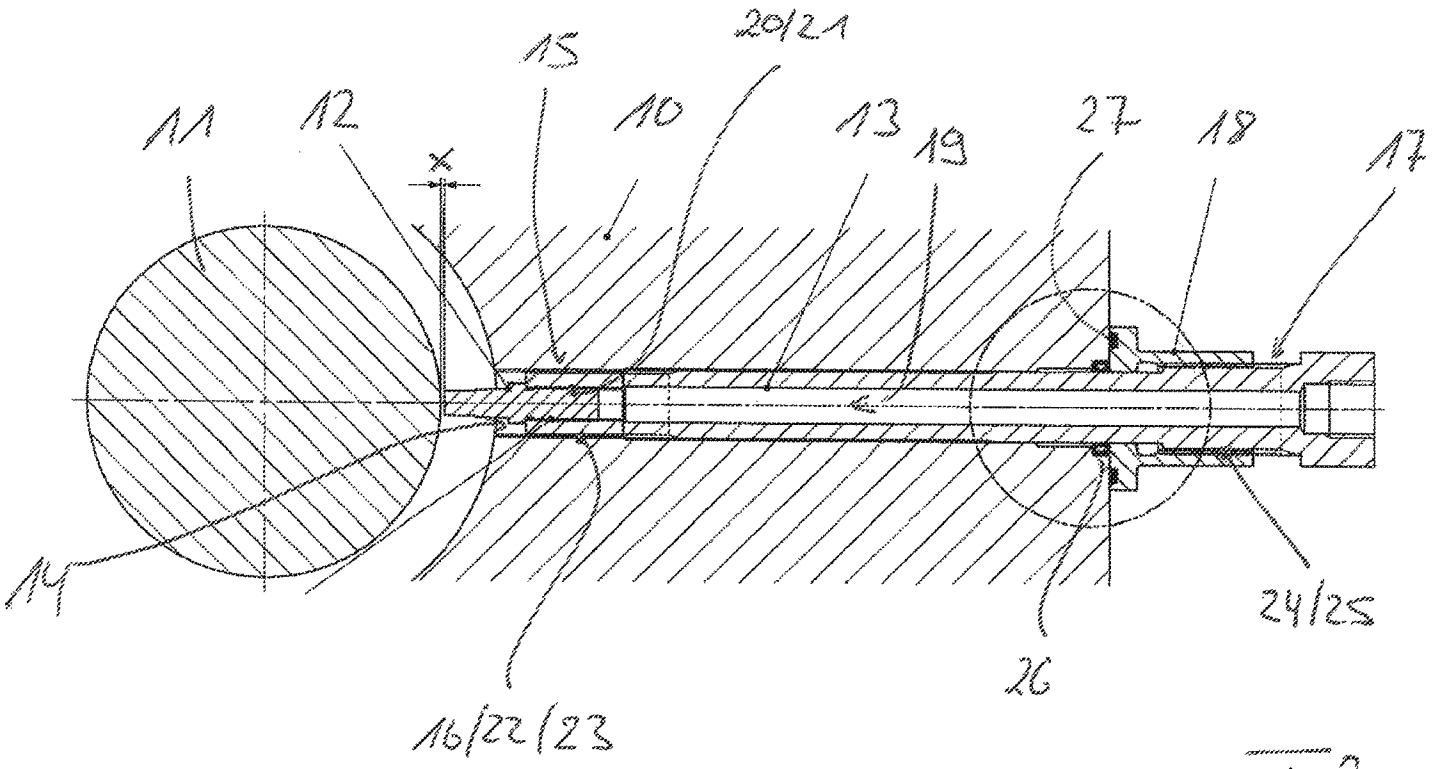
FIG. 2: is a design embodiment of the detail of FIG. 1.
Figure 3:
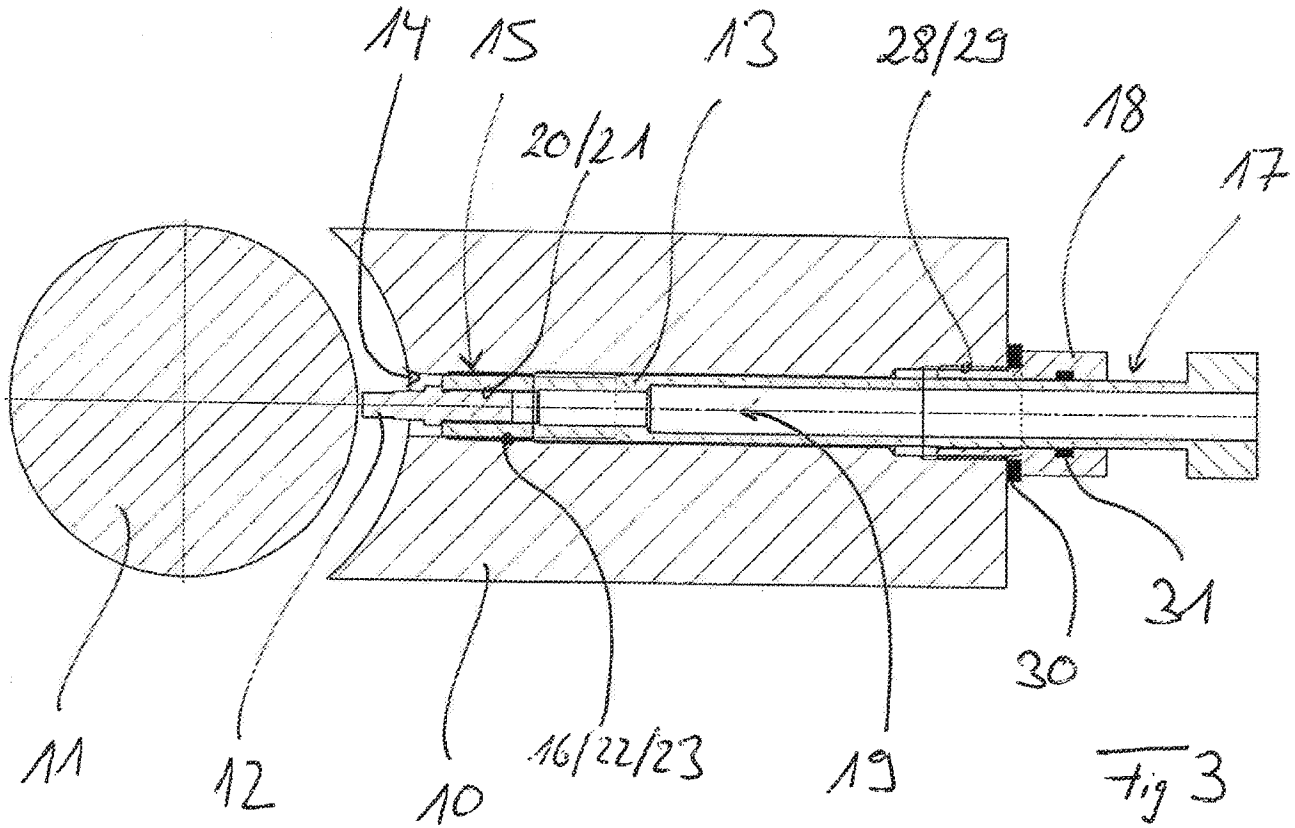
FIG. 3 is a further design embodiment of the detail of FIG. 1.

Further details of the invention are described in the following making reference to FIGS. 2 and 3, wherein FIGS. 2 and 3 show possible design embodiments of the schematic representation of FIG. 1.

In FIG. 2, the machine housing 10 of the fluid energy machine and a shaft 11 mounted in the machine housing are shown together with a sensor 12 for vibration detection of the shaft 11. The sensor 12 is mounted on a mounting sleeve 13, namely on a first end or portion 15 of the mounting sleeve 13, which faces the shaft 11. The mounting sleeve 13 in this case extends again through a bore 14 in the machine housing 10, wherein the mounting sleeve 13 is embodied in a tubular manner. An internal thread 20 which is formed on the first end 15 of the mounting sleeve 13 serves for mounting the sensor 12 on the mounting sleeve 13, which internal thread interacts with a corresponding external thread 21 of the sensor 12, wherein between the internal thread 20 and the external thread 21 sealing element (not shown) is positioned.

In the shown exemplary embodiments, the mounting sleeve 13 with its first end or portion 15 does not project out of the bore 14 of the machine housing 10, merely the sensor 12 projects out of the bore 14 of the housing 10.

The exact alignment of the sensor 12 to the shaft 11 is effected via the adjusting device 16, which in the exemplary embodiment of FIG. 2 is embodied as adjusting thread. The adjusting thread comprises an external thread 22 on the first end or portion 15 of the mounting sleeve 13 and an internal thread 23 on a portion of the bore 14 facing the shaft 11. By twisting the mounting sleeve 13 within the bore 14 of the machine housing 10 via this adjusting thread, the sensor 12 can be exactly aligned to the shaft 11, namely subject to adjusting a defined gap x between the shaft 11 and the vibration sensor 12.

As already explained, the mounting sleeve 13 is fixed on the machine housing 10 on the second end or portion 17 located opposite the first end or portion 15, with which the mounting sleeve 13 according to FIG. 2, projects out of the bore 14 of the machine housing 10, namely via the fixing device 18 which in the exemplary embodiment of FIG. 2 is provided by a lock nut.

The lock nut 18 comprises an internal thread 24, which interacts with a corresponding internal thread 25 of the mounting sleeve 13, wherein this external thread 25 is formed on the second end or portion 17 of the mounting sleeve 13 that projects out of the bore 14 of the machine housing 10 facing away from the shaft.

By tightening the lock nut 18, the mounting sleeve 13 is fixed on the machine housing 10, namely clamped in the exemplary embodiment of FIG. 2.

Here, as is evident from FIG. 2, a sealing element 26 is positioned between the mounting sleeve 13 and the machine housing 10 within the bore 14 on a portion of the bore 14 facing away from the shaft 11, which seals the mounting sleeve 13 with respect to the bore 14, namely in particular when the mounting sleeve 13 is clamped to the machine housing 10 via the lock nut 18. A further sealing element 27 is positioned outside the bore 14 between the machine housing 10 and a portion of the lock nut 18 abutting the machine housing 10.

In order to carry out the fine adjustment or exact alignment of the sensor 12 relative to the shaft 11, the lock nut 18 in the version of FIG. 2 has to be loosened. Only after the exact alignment of the sensor 12 relative to the shaft 11 via the adjusting device 15 is the mounting sleeve 13 fixed on the housing 10 via the lock nut 18.

In contrast with the exemplary embodiment of FIG. 2 it is also possible according to FIG. 2 that the fixing device 18 is designed as a hollow screw which just like the lock nut 18 surrounds the mounting sleeve 13 on the second end or portion 17 projecting out of the bore 14 in portions radially on the outside, wherein however this hollow screw comprises an external thread 28 which interacts with an internal thread 29 of the bore 14 which is formed on the portion of the bore 14 facing away from the shaft 11. In this case, the fixing device 18 then preferentially comprises a sealing/clamping element 31 in addition, which is positioned between the hollow screw and the mounting sleeve 13 and assumes the sealing between mounting sleeve 13 and the hollow screw. For sealing between machine housing 10 and hollow screw, a further sealing element 30 is positioned between the hollow screw and the machine housing 10. In order to carry out the fine adjustment or exact alignment of the sensor 12 relative to the shaft 11, the hollow screw 18 in the version of FIG. 3 need not be loosened.

In terms of the present invention, the function of adjusting or alignment of the sensor 12 relative to the shaft 11 and the fixing of a mounting sleeve 13 supporting the sensor 12 is present separated from one another in terms of space and function. The adjustment is assumed by an adjusting device 16 which is preferentially designed as an adjusting thread, namely on the end or portion 15 of the mounting sleeve 13, which faces the shaft 11. Because of this, the risk of vibration excitations for the sensor 12 is also minimised. The fixing device 18, which fixes or secures the mounting sleeve 13 on the machine housing 10 and seals the same relative to the machine housing 10, engages on the opposite end or portion 17 of the mounting sleeve 13.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

LIST OF REFERENCE NUMBERS

10 Machine housing
11 Shaft
12 Sensor
13 Mounting sleeve
14 Bore
15 Portion
16 Adjusting device
17 Portion
18 Fixing device
19 Bore
20 Internal thread
21 External thread
22 External thread
23 Internal thread
24 Internal thread
25 External thread
26 Sealing element
27 Sealing element
28 External thread
29 Internal thread
30 Sealing element
31 Sealing/clamping element

The invention claimed is:

1. A fluid energy machine comprising:

a machine housing (10) having a bore (14) and at least one shaft (11) mounted in said machine housing (10);

at least one sensor (12) constructed for detecting vibrations of said shaft (11);

at least one mounting sleeve (13) extending through said bore (14) in said machine housing (10);

said mounting sleeve (13) comprising a first end portion (15) facing said shaft (11) and a second end portion (17) facing away from said shaft (11), said sensor (12) being mounted on said first end portion (15);

an adjusting device (16) in the region of said first end portion (15) of said mounting sleeve (13) constructed for aligning said sensor (12) relative to said shaft (11);

a fixing device (18) disposed on said second end portion (17) constructed for fixing and sealing said mounting sleeve (13) on said machine housing (10);

wherein said adjusting device (16) is designed as an adjusting thread; and wherein said adjusting thread comprising an external thread (22) on said first end portion (15) of said mounting sleeve (13) and an internal thread (23) on a portion of said bore (14) facing said shaft (11) opposite to and cooperating with said external thread (22) on said first end portion (15).

2. The fluid energy machine according to claim 1, additionally comprising an internal thread (20) formed on said first end portion (15) of said mounting sleeve (13) and an external thread (21) at said sensor (12), wherein said internal thread (20) interacts with said external thread (21); and a sealing element (26, 27) positioned between said internal thread (20) and said external thread (21).

3. The fluid energy machine according to claim 1, wherein said fixing device (18) is a lock nut comprising an internal thread (25), said internal thread (25) of said lock nut engaging on said external thread (24) of said mounting sleeve (13); said second end portion (17) of said mounting sleeve (13) projecting from said bore (14).

4. The fluid energy machine according to claim 3, additionally comprising a first sealing element (26) disposed between said mounting sleeve (13) and said machine housing (10) within said bore (14) on a portion of said bore (14) facing away from said shaft (11).

5. The fluid energy machine according to claim 4, additionally comprising a second sealing element (27) disposed between said machine housing (10) and a portion of said lock nut (18) and butting up against said machine housing (10).

6. The fluid energy machine according to claim 1, wherein said fixing device (18) comprises a hollow screw surrounding said mounting sleeve (13) on said second end portion (17) projecting out of said bore (14) of said machine housing, wherein said hollow screw comprises an external thread (28) and said bore (14) comprises an internal thread (29) on a portion of said bore (14) facing away from said shaft (11), and wherein said external thread (28) of said fixing device (18) engages on said internal thread (29) of said bore (14).

7. The fluid energy machine according to claim 6, additionally comprising a sealing element (30) positioned between said hollow screw and said machine housing (10).

8. The fluid energy machine according to claim 6, wherein said fixing device comprises a sealing/clamping element (31), which serves as a seal between said hollow screw and said mounting sleeve (13).

9. The fluid energy machine according to claim 8, additionally comprising a sealing element (30) positioned between said hollow screw and said machine housing (10).

10. The fluid energy machine according to claim 1, wherein the fluid energy machine is a screw machine, wherein screw rotors forming a rotor pair are positioned in the machine housing, and wherein a shaft of at least one of said screw rotors is assigned at least one of said sensors for detecting vibrations of said shaft.

11. The fluid energy machine according to claim 10, wherein said screw machine is a screw compressor.

12. The fluid energy machine according to claim 1, wherein said fixing device (18) is a lock nut comprising an internal thread (25), said internal thread (25) of said lock nut engaging on said external thread (24) of said mounting sleeve (13); said second end portion (17) of said mounting sleeve (13) projecting from said bore (14).

13. The fluid energy machine according to claim 1, wherein said fixing device (18) is a lock nut comprising an internal thread (25), said internal thread (25) of said lock nut engaging on said external thread (24) of said mounting sleeve (13); said second end portion (17) of said mounting sleeve (13) projecting from said bore (14).

14. The fluid energy machine according to claim 1, wherein said fixing device (18) comprises a hollow screw surrounding said mounting sleeve (13) on said second end portion (17) projecting out of said bore (14) of said machine housing, wherein said hollow screw comprises an external thread (28) and said bore (14) comprises an internal thread (29) on a portion of said bore (14) facing away from said shaft (11), and wherein said external thread (28) of said fixing device (18) engages on said internal thread (29) of said bore (14).

15. The fluid energy machine according to claim 1, wherein said fixing device (18) comprises a hollow screw surrounding said mounting sleeve (13) on said second end portion (17) projecting out of said bore (14) of said machine housing, wherein said hollow screw comprises an external thread (28) and said bore (14) comprises an internal thread (29) on a portion of said bore (14) facing away from said shaft (11), and wherein said external thread (28) of said fixing device (18) engages on said internal thread (29) of said bore (14).

* * * * *